United States Patent [19]

Hashimoto

[11] Patent Number: 5,064,993

[45] Date of Patent: Nov. 12, 1991

[54] HAIR TREATING IMPLEMENT WITH A HEATED WIRE ELEMENT

[76] Inventor: Kenji Hashimoto, 6-20, Todoroki 7-chome, Setagaya-ku, Tokyo, Japan

[21] Appl. No.: 504,629

[22] Filed: Apr. 4, 1990

[30] Foreign Application Priority Data

Apr. 11, 1989 [JP] Japan ..... 1-42194[U]
Dec. 29, 1989 [JP] Japan ..... 1-152799[U]

[51] Int. Cl.[5] ..... H05B 1/02; H05B 3/00; A45D 26/00

[52] U.S. Cl. ..... 219/223; 30/116; 30/140; 83/16; 83/171; 132/118; 219/233; 219/240

[58] Field of Search ..... 219/222, 223, 233, 235, 219/240; 132/118; 30/140, 116; 83/15, 16, 170, 171

[56] References Cited

U.S. PATENT DOCUMENTS

| | | | |
|---|---|---|---|
| 558,465 | 4/1896 | Bell | 132/118 |
| 589,445 | 9/1897 | Seide | 132/118 |
| 1,720,775 | 7/1929 | Welden | 132/118 |
| 1,744,525 | 1/1930 | Chase | 132/118 |
| 2,386,409 | 10/1945 | Saffady | 30/116 |
| 2,471,019 | 5/1949 | Baker | 219/223 |
| 2,491,708 | 12/1949 | Bradley | 219/223 X |
| 2,727,132 | 12/1955 | Hills | 219/223 |
| 3,093,724 | 6/1963 | Johnson | 132/118 |
| 3,176,114 | 3/1965 | Kneisley | 219/223 |
| 3,474,224 | 10/1969 | Carter | 219/223 |
| 3,992,605 | 11/1976 | Kraus et al. | 219/233 |
| 4,614,858 | 9/1986 | Vial | 219/233 X |

FOREIGN PATENT DOCUMENTS

| | | | |
|---|---|---|---|
| 102289 | 3/1984 | European Pat. Off. | 219/223 |
| 2107951 | 8/1972 | Fed. Rep. of Germany | 219/223 |
| 903526 | 10/1945 | France | 219/223 |
| 2531655 | 2/1984 | France | 219/223 |
| 2612381 | 9/1988 | France | 219/223 |
| 73334 | 12/1949 | Norway | 219/223 |
| 835781 | 7/1981 | U.S.S.R. | 30/140 |
| 10083 | of 1906 | United Kingdom | 219/223 |

*Primary Examiner*—Anthony Bartis
*Attorney, Agent, or Firm*—Sandler, Greenblum, & Bernstein

[57] ABSTRACT

A hair treating implement which has an electrical heating wire, a slidably removable support which the heating wire under tension, and a hand grip which can be connected with the support. The support is detachably connected to the hand grip by a longitudinally slidable tongue—and—groove interfit, and when connected, is engaged with electrical contacts in the hand grip. Electrical power is supplied to the heating wire through either an internal power source or an external power source, and hair is cut by the heating wire which is heated by the electrical power.

36 Claims, 10 Drawing Sheets

HAIR TREATING IMPLEMENT WITH A HEATED WIRE ELEMENT

BACKGROUND OF THE INVENTION

1. Field of the Invention

The present invention relates to a hair treating implement, and more precisely it relates to a new hair remover or hair dresser which can be advantageously used to cut or dress unwanted body hair.

2. Description of Related Art

A conventional cutting tool, such as scissors or a razor is used to treat hair of the head or body hair or to cut unwanted hair, in particular before one wears a hi-leg swim suit. However, the conventional cutting tool is dangerous because the cutting portions are exposed. Further, the tips of the cut hair are sharp due to shear cutting. The sharp tips easily thrust into clothes (e.g. swim suit) which one wears and protrude out of the clothes in an unsightly manner or causes one to feel pain upon touching.

SUMMARY OF THE INVENTION

The primary object of the present invention is to provide a hair treating implement which eliminates the above-mentioned drawbacks and which has an electrical heating wire which burns and cuts the hair so as to leave a round tip on the hair.

To achieve the object mentioned above, according to the present invention, there is provided a hair treating implement comprising an electrical heating wire, a support which tautly supports the heating wire and which is provided with terminals at the opposite ends of the heating wire to supply and electrical power thereto, and a hand grip which is connected to the support.

In another aspect of the present invention, the support which tautly holds the heating wire is slidably and removably positioned within the implement. This allows easy removal of the support in order to access the wire if such should break or need repair.

It is still a further aspect of the present invention to provide comb teeth portions along either side of the wire. These comb teeth portions prevent the heated wire from touching the skin of the operator during operation.

In another aspect of the present invention, the hand grip of the implement is provided with a battery compartment for housing batteries. The batteries supply power to the heating wire.

According to another aspect of the present invention, the hand grip includes a connector section which allows the wire to be connected to an external power source.

In yet another aspect of the present invention to meet the above-identified objectives, the implement is provided with a power control circuit which permits electrical power to be supplied to the wire. The circuit includes a timing circuit which allows power to be supplied to the wire in predetermined intervals.

With this arrangement, since the hair is burnt and cut by the heat of the electrical heating wire, unlike the prior art in which the hair is cut by the shearing action of a cutting tool, such as a razor or scissors, the tips of the hair are rounded, and accordingly, the round tips create a smooth, stream of hair and have a natural feeling. Furthermore, particularly in the treatment of flagged or split ends of hair of a human head, the round tips of the cut hair can be easily dressed, permed, and arranged, so that a desired hair style can last for a long period of time.

BRIEF DESCRIPTION OF THE DRAWINGS

A detailed description of the present invention will be made below in detail based on preferred embodiments shown in the attached drawings, in which.

DESCRIPTION OF PREFERRED EMBODIMENTS

Figure 1A:
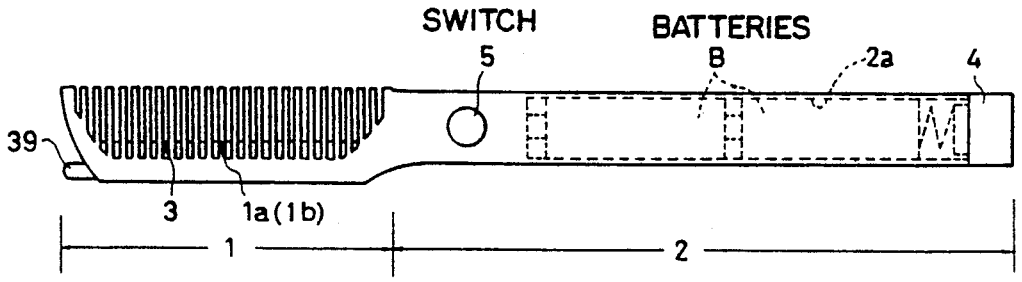
FIGS. 1A and 1B are a side elevational view and a plan view of a hair treating implement, according to a first embodiment of the present invention, respectively.
Figure 1B:
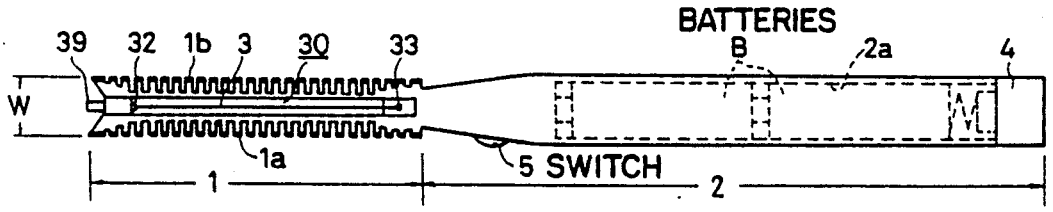
Figure 2A:
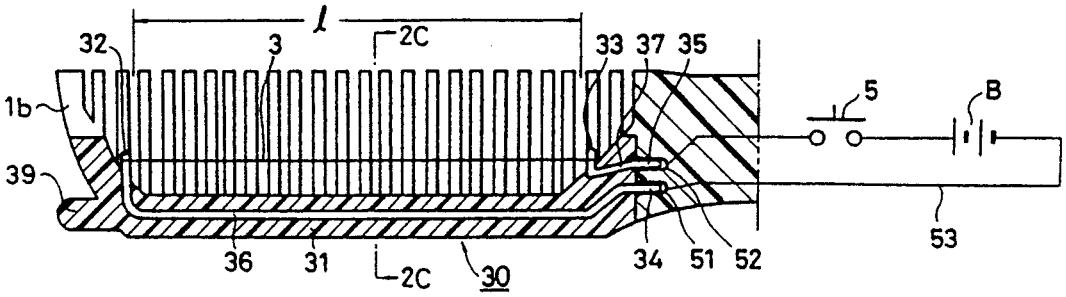
FIGS. 2A and 2B are an enlarged sectional side elevational view and a front end view, of a comb tooth portion of a hair treatment implement shown in FIGS. 1A and 1B, respectively.
Figure 2C:
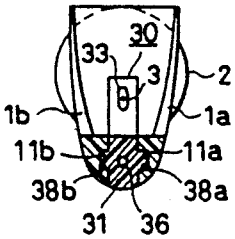
FIG. 2C is a longitudinal sectional view taken along the line 2C—2C in FIG. 2A.
Figure 2B:
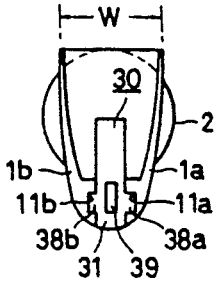
Figure 3A:
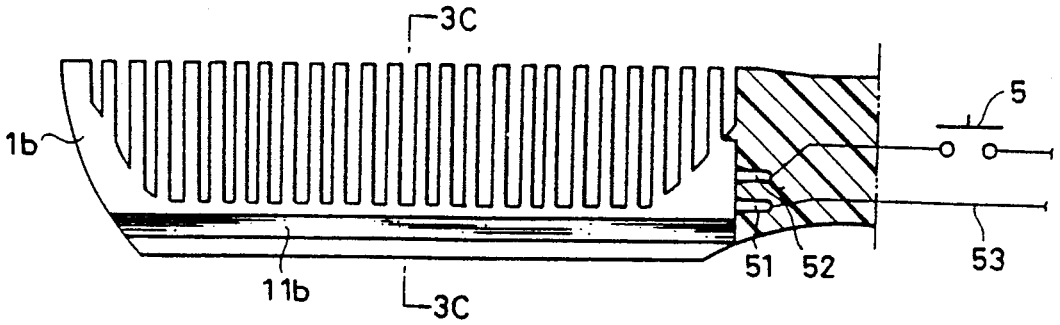
FIGS. 3A and 3B are an enlarged side elevational view and a front end view, of a comb tooth portion of a hair treatment implement with a removed heater cassette (cartridge) shown in FIGS. 1A and 1B, respectively.
Figure 3C:
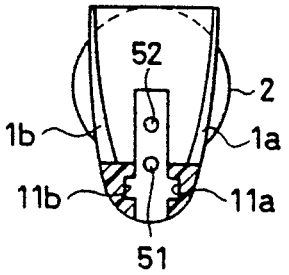
FIG. 3C is a longitudinal sectional view taken along the line 3C—3C in FIG. 3A.
Figure 3B:
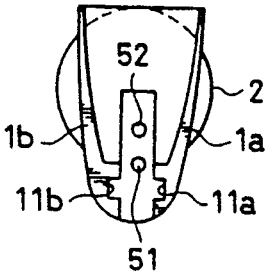

FIGS. 1A and 1B show a first embodiment of the present invention in which a hair treating implement of the present invention essentially has a comb tooth portion 1 and a hand grip 2 which is connected to one end of the comb tooth portion 1. The comb tooth portion 1 has a pair of first and second comb tooth plates 1*a* and 1*b* which are spaced from one another at a distance W (e.g. about 5 mm) and which are symmetrically opposed to each other with respect to a longitudinal center line of the hair treating implement. In space W defined by and between the comb tooth plates 1*a* and 1*b* an electrical heating wire 3 is provided which extends in the longitudinal direction of the hair treatment implement in the vicinity of the base portions of the comb teeth. The electrical heating wire 3 is included in an interchangeable heater cassette (cartridge) 30 which is provided between comb tooth plates 1*a* and 1*b*. The hand grip 2 has a hollow portion which defines a battery compartment 2*a* in which batteries B are stored. In the illustrated embodiment, two or three batteries B, such as SUM-3 batteries, serve compartment as a power source and are received in the battery 2*a* of the grip 2 which is closed by a plug cap 4 detachably attached to the open end of the battery compartment 2*a*. The grip 2 has a push button switch 5 to start the operation of the hair treatment implement, wherein the power supply of battery B is applied to the heating wire 3.

Figure 4:
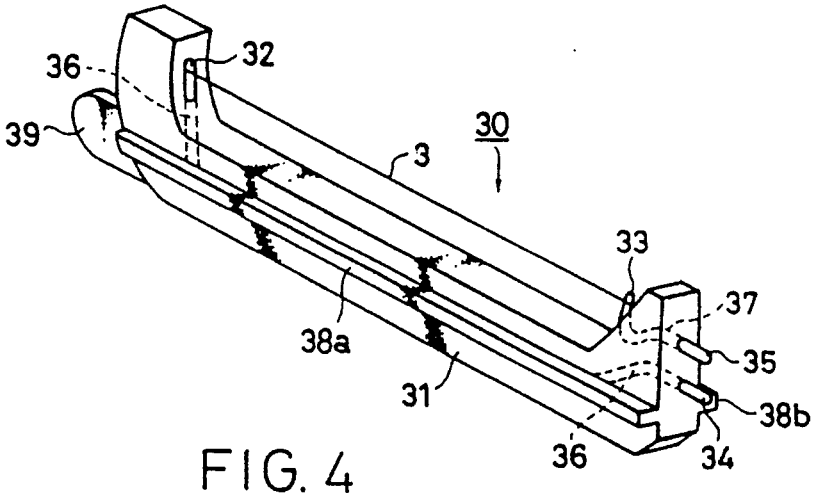
FIG. 4 is a perspective view of a heater cassete used in the present invention.

FIGS. 2A through 2C and FIGS. 3A through 3C show a comb tooth portion 1 in the first embodiment of the present invention. FIG. 4 shows the heater cassette 30 used in the hair treatment implement.

The heater cassette 30 has a generally arched substrate 31 which has a shape corresponding to the shape of the spine portion of the comb tooth plates 1*a* and 1*b*. First and second electrical conductive terminals 32 and 33 are provided to project from the inner faces at the front and rear end portions of substrate 31. The above-mentioned electrical heating wire 3 extends tautly between the terminals 32 and 33. The heater cassette 30 also has first and second projecting terminals 34 and 35 which project rearward from the substrate 31, a first conductor (connecting line) 36 for connecting the first conductive terminal 32 and the first projecting terminal 34, a second conductor (connecting line) 37 for connecting the second conductive terminal 33 and the second projecting terminal 35, longitudinally extending elongated guide projections 38*a* and 38*b* which are provided on the right and left side faces of the substrate 31, and a front lug 39 which is provided on the front face of the substrate 31. The arched portion of substrate 31 is slidingly received in the spine portion of the comb tooth plates by a "tongue-and-groove" type connection.

In the illustrated embodiment, the first conductive terminal 32, the first conductor 36 and the first projecting terminal 34 are made of a single annealed aluminium wire which is properly bent. Similarly, the second conductive terminal 33, the second conductor 37 and the second projecting terminal 35 are made of a single annealed aluminium wire which is properly bent. The first and second conductors 36 and 37 are embedded in the substrate 31 which is molded of heat-resisting resin, such as polycarbonate-DELRIN (polyacetal resin), together with the elongated guide projections 38*a* and 38*b* and the front lug 39. The heating wire 3 is made of NICHROME fine wire of about 0.1–0.14 mm $\phi$ or may be a sheathed heater. In the illustrated embodiment, the effective length l of the NICHROME wire 3 is 40–50 mm and it has a high electrical resistance, so that when a voltage of 3–4.5 V is applied to the opposite ends of the heating wire 3, the wire 3 generates a red heat or is heated without being burned and broken.

On the inner side faces of the spine portions of the right and left comb tooth plates 1*a* and 1*b* of the comb tooth portion 1 are provided longitudinally elongated guide grooves 11*a* and 11*b* in which the corresponding left and right guide projections 38*a* and 38*b* of the heater cassette 30 can be in a "tongue-and-groove" fashion. On the front face of the hand grip 2 are provided first and second power supplying receptacles (suppliers) 51 and 52 in which the corresponding first and second projecting terminals 34 and 35 are received to establish an electrical connection therebetween.

The comb tooth portion 1 and the hand grip 2 are made of a heat-resisting resin material, similar to the heater cassette 30.

The heater cassette 30 is inserted in the space between the comb tooth plates 1*a* and 1*b* from the front end side of the comb tooth portion 1 in such a way that the guide projections 38*a* and 38*b* of the heater cassette 30 slide in the associated guide grooves 11*a* and 11*b* of the comb tooth portion 1. When the heater cassette 30 is completely inserted in the body of the hair treating implement, the first and second projecting terminals 34 and 35 are engaged in the corresponding first and second receptacles 51 and 52 of the hand grip 2, establishing the electrical connection. Upon inserting the heater cassette 30, the leading end thereof is the end on which the projecting plugs 34 and 35 are provided. When heater cassette 30 is attached to the comb tooth portion 1, the heating wire 3 extends between the left and right comb tooth plates 1*a* and 1*b* under tension, close to the base portion of the comb teeth, as can be seen from FIGS. 1B and 2A.

When a user who grasps the hand grip 2, pushes the push button switch 5 to turn the switch ON, a closed electrical circuit results comprising the switch 5, the batteries B housed in the battery compartment 2*a* of the hand grip 2, a line 53 (FIG. 2A), the first receptacle terminal 51, the first projecting terminal 34, the first conductor 36, the first conductive terminal 32, the heating wire 3, the second conductive terminal 33, the second conductor 37, the projecting terminal 35, the second receptacle 52 and, the switch 5 is formed. Consequently, the heating wire 3 immediately reaches a red-heat state along the length thereof.

When the push button switch 5 is released, the above-mentioned electrical circuit is broken, so that the heating wire 3 stops generating red-heat and rapidly decreases in temperature due to its small heat capacitance.

Thus, when the heating wire 3 is brought into contact with the body hair at a desired length of the hair, while combing the hair by the comb tooth portion 1, if the push button switch 5 is pushed down, the heating wire 3 generates red-heat, so that the body hair with which the heating wire comes into contact is easily burned and cut. The tip edges of the burned and cut hair are not sharp but round, unlike the case where the hair is sheared by a cutting tool (scissors etc.), thus resulting in eliminating the drawback of the prior art mentioned before.

It should be noted that no direct contact of the heating wire 3 with a user's skin occurs, since the heating wire 3 is placed in the space between the right and left comb tooth plates 1*a* and 1*b*.

If the heating wire is broken, the front lug 39 of the heater cassette 30 is grasped with user's fingers to pull the heater cassette out in the opposite direction of its insertion to thereby disengage the same from the comb tooth portion 1, so that the heater cassette 30 can be exchanged for a new cassette. Thus, the interchangeability of the heater cassette or the heating wire has economical merit.

Figure 5:
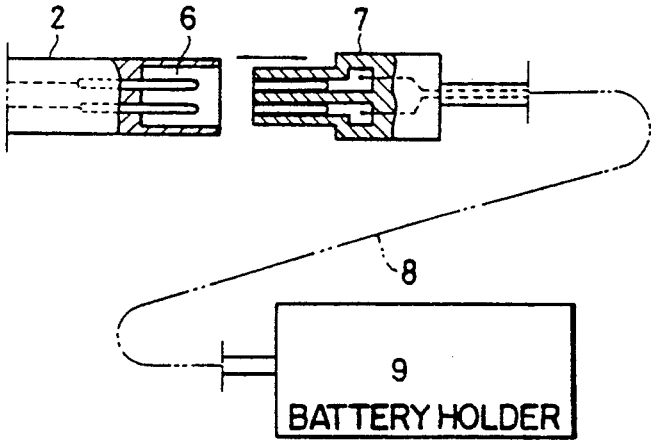
FIG. 5 is a sectional view of a receptacle and a power supply connection plug used in the present invention.

The batteries B received in the hand grip 2 provide an easily operable, cordless hair treating implement. Alternatively, it is possible to provide a receptacle 6, for example, on the rear end of the hand grip 2, so that a detachable plug 7 which is connected to a separate battery holder 9 with batteries through a cord 8 can be inserted in the receptacle 6 to supply the power to the hair treatment implement, as shown in FIG. 5. The separate battery holder 9 makes the hair treatment implement lighter and more operable. It is possible to directly connect the hair treatment implement to the separate battery holder through the connecting cord without using the receptacle and the plug. It is also possible to connect the hair treating implement to a commercial power source through a voltage reducer by a connecting cord.

Figure 6:
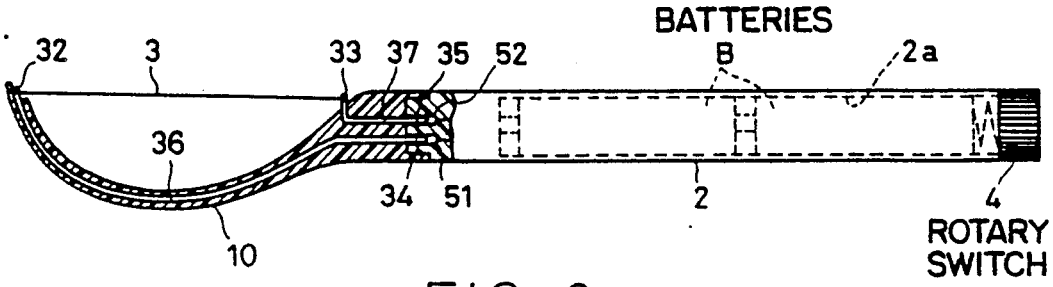
FIG. 6 is a partially sectional side elevational view of a hair treating implement, according to a second embodiment of the present invention.
Figure 7:
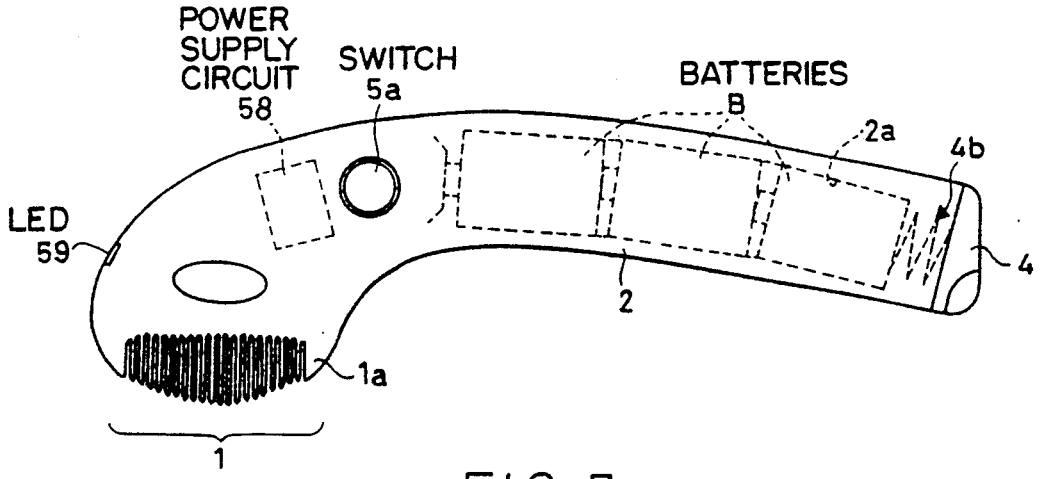
FIGS. 7, 8, 9, 10, 11 and 12 are a side elevational view, a plan view, a bottom view, a front elevational view, a back view and a perspective view, of a hair treating implement, according to a third embodiment of the present invention, respectively.

FIG. 6 shows another embodiment of the present invention, in which the components corresponding to those in FIGS. 1 through 4 are designated with the same numerals as those in FIGS. 1 through 4. In the embodiment shown in FIG. 6, the heating wire 3 strings between the opposite ends of an archwise body member 10, like a chord of a circle. The plug cap 4 provided on the rear end of the hand grip 2 serves also as a rotary switch to turn the hair treating implement ON and OFF. The archwise body member 10 having the heating wire 3 is detachably attached to the front end of the hand grip 2, so that the archwise body member 10 can be exchanged, in case of a breakage of the heating wire 3. When the archwise body member 10 is attached to the hand grip 2, the first and second projecting terminals 34 and 35 of the archwise body member 10 are electrically connected to the first and second supplier recessed terminals 51 and 52 of the hand grip 2.

The hair treating implement shown in FIG. 6 can be particularly advantageous when used as a hair dressing tool in a barber or beauty shop. Namely, the heating wire 3 is brought into slide-contact with the tips of the dressed hair to burn and cut the same, so that the cut tips are rounded, curled, or frizzled to obtain a desired hair style.

The hair treating implement shown in FIGS. 1 through 4 can be also used, of course, as a hair dressing tool in a barber or beauty shop.

Figure 8:
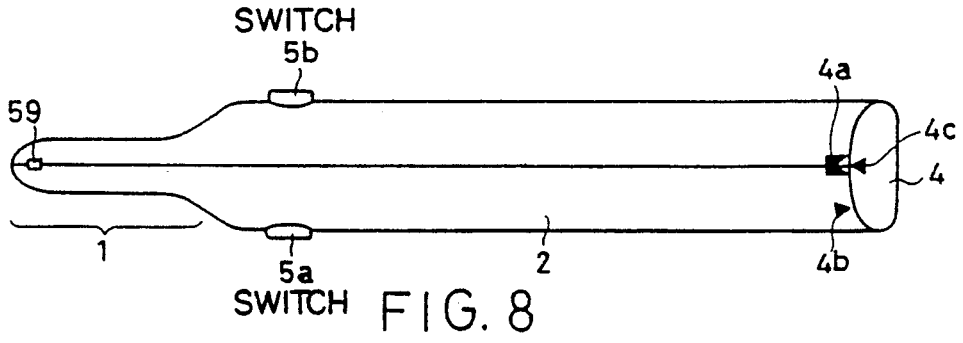
Figure 9:
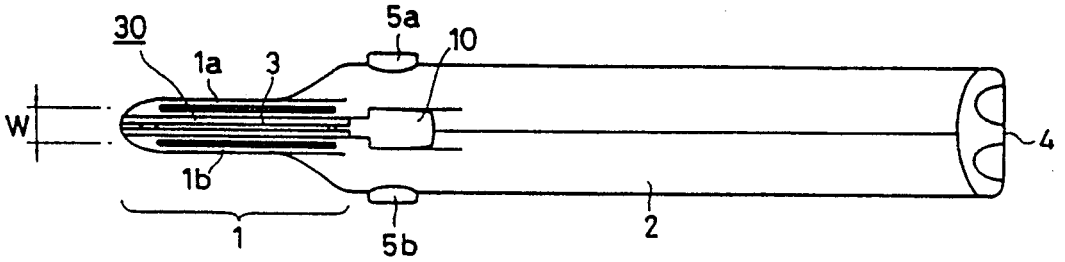
Figure 11:
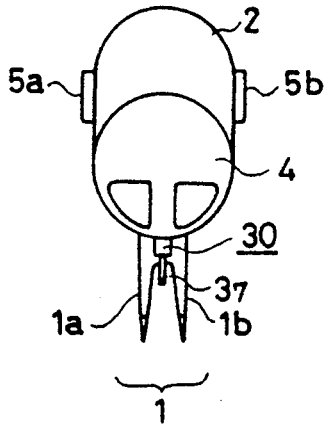
Figure 10:
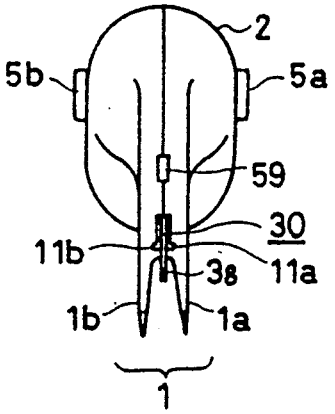

FIGS. 7 through 12 show a third embodiment of the present invention, in which the hair treating implement essentially includes a comb tooth portion 1 and a hand grip 2 connected to one end of the comb tooth portion 1. As shown in FIG. 9 the comb tooth portion 1 has a pair of comb tooth plates 1*a* and 1*b* which are spaced from one another at a distance W (e.g. about 5 mm), in a symmetrical arrangement with respect to the longitudinal axis of the comb tooth portion 1. The electrical heating wire 3 strings close to the base end portion of the comb teeth, in the space (distance W) defined between and by the comb tooth plates 1*a* and 1*b*. The heating wire 3 is included in the interchangeable heater cassette 30 (FIG. 12) which can be detachably inserted in the space between the comb tooth plates 1*a* and 1*b*. The hand grip 2 has a hollow body which constitutes a battery compartment 2*a* in which the batteries B (e.g. three SUM-2 type batteries) are stored and which is closed by the plug cap 4. Left and right push button switches 5*a* and 5*b* are provided on the opposite side faces of the hand grip 2 adjacent to the comb tooth portion 1.

The comb tooth plates 1*a* and 1*b*, the hand grip 2, and the plug cap 4 are molded of synthetic resin such as ABS resin, polycarbonate resin, DELRIN resin or the like.

Figure 16:
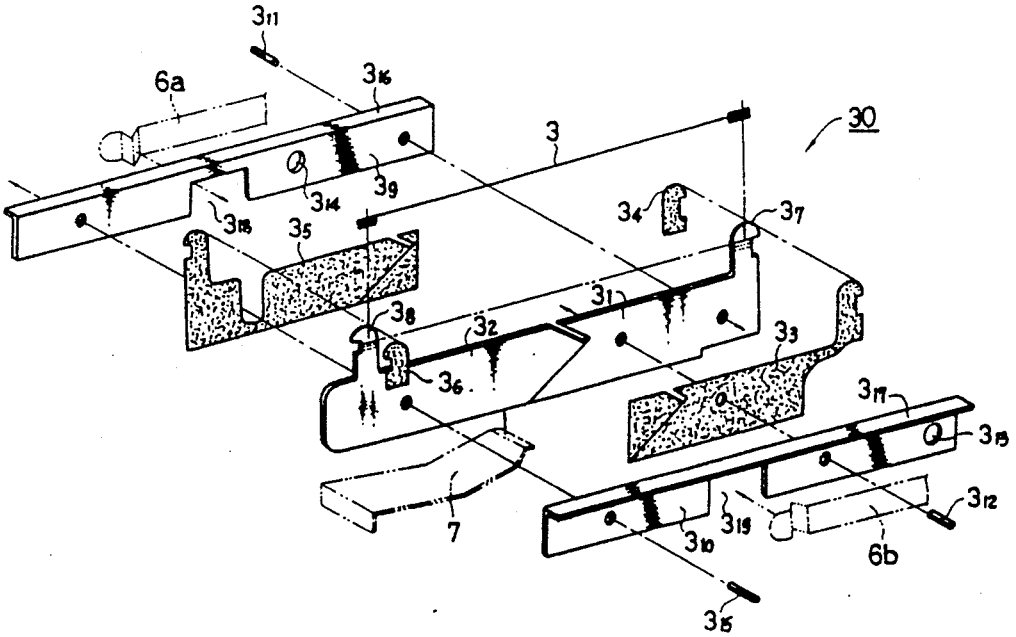
FIG. 16 is an exploded perspective view of a heater cartridge, according to the third embodiment of the present invention.

As can be seen in FIG. 16, the heater cassette 30 has an elongated substrate having electrically insulated front and rear base plates $3_1$ and $3_2$ of, for example, glass epoxy, and are split from one another at the center portion of the substrate along an oblique line. Furthermore, patterns of conductor layers (Cu) $3_3$, $3_4$, $3_5$, and $3_6$ are formed on the side faces of the front and rear base plates $3_1$ and $3_2$, and electrical heating wire 3 (e.g. NICHROME fine wire of 0.1–0.14 mm $\phi$) strings between a front upward projection $3_7$ of the front end of the front base plate $3_1$ and a rear upward projection $3_8$ of the rear end of the rear base plate $3_2$, and elongated left and right side plates $3_9$ and $3_{10}$ which hold therebetween the substrate (i.e. the front and rear base plates $3_1$ and $3_2$) in a sandwich fashion and which have a generally inverted L-shaped cross section.

The substrate consisting of the front base plate $3_1$ and the rear base plate $3_2$ forms a printed circuit board. Namely, the conductor pattern layers $3_3$ and $3_4$ are formed on the substantially whole right side face of the front base plate $3_1$ and the left side face of the projection $3_7$ thereof, respectively, and the conductor pattern layers $3_5$ and $3_6$ are formed on the substantially whole left side face of the rear base plate $3_2$ and the right side face of the projection $3_8$ thereof, respectively.

The front base plate $3_1$ and the left side plate $3_9$ are interconnected by a pin $3_{11}$ which extends through the front base plate $3_1$ and the left side plate $3_9$ and is calked. Similarly, the front base plate $3_1$ and the right side plate $3_{10}$ are interconnected by a pin $3_{12}$ which extends through the front base plate $3_1$ and the right side plate $3_{10}$ and is also calked. Accordingly, the front base plate $3_1$ and the left and right side plates $3_9$ and $3_{10}$ are integrally connected to each other by the pins $3_{11}$ and $3_{12}$.

In the illustrated embodiment the left and right side plates $3_9$ and $3_{10}$ are made of metal plates, such as iron plates, and pins $3_{11}$ and $3_{12}$ are also made of metal. To prevent the left and right side plates $3_9$ and $3_{10}$ from being electrically connected to each other through the metal pins $3_{11}$ and $3_{12}$, the right side plate $3_{10}$ is provided with a through hole $3_{13}$ which has a diameter larger than the associated pin $3_{11}$, so that the pin $3_{11}$ which secures the front base plate $3_1$ to the left side plate $3_9$ does not contact the right side plate $3_{10}$. Similar, the left side plate $3_9$ is provided with a through hole $3_{14}$ which has a diameter larger than the associated pin $3_{12}$, so that the pin $3_{12}$ which secures the front base plate $3_1$ to the right side plate $3_{10}$ does not contact the left side plate $3_9$. Alternatively, it is possible to make the side plates $3_9$ and $3_{10}$ and the pins $3_{11}$ and $3_{12}$ of an electrically insulated material, dispensing with the above-mentioned through holes $3_{13}$ and $3_{14}$.

The rear base plate $3_2$ and the left and right side plates $3_9$ and $3_{10}$ are connected by a single electrically insulated pin $3_{15}$, so that the rear base plate $3_2$ can rotate about the pin $3_{15}$ between the side plates $3_9$ and $3_{10}$.

The thin NICHROME wire 3 is firmly connected to the front and rear projections $3_7$ and $3_8$ of the front base plate $3_1$ and the rear base plate $3_2$ to have an effective length of, for example, 40–50 mm.

Figure 17:
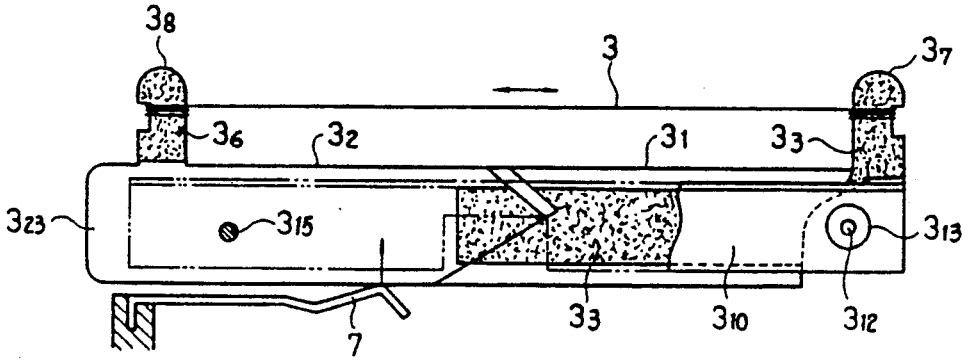
FIG. 17 is a side elevational view of a heater cartridge in an inactive position in which no electrical power is supplied to a nichrome wire, in the third embodiment of the present invention.

Due to the tension of the NICHROME wire 3, the rear base plate $3_2$ is biased to have a rotational moment about the insulation pin $3_{15}$ in the clockwise direction in FIG. 17, so that a downward inclined edge (lower oblique edge) of the inclined front end of the rear base plate $3_2$ is pressed against an upwardly inclined edge (upper oblique edge) of the rear oblique end of the front base plate $3_1$.

The spine portion of the left and right comb tooth plates 1*a* and 1*b* of the comb tooth portion 1 is provided, on its inner side faces, with elongated guide grooves 11*a* and 11*b* (FIGS. 10, 12 and 13) in which the left and right guide projections $3_{16}$ and $3_{17}$ of the heater cassette 30 are slidably engaged.

Figure 12:
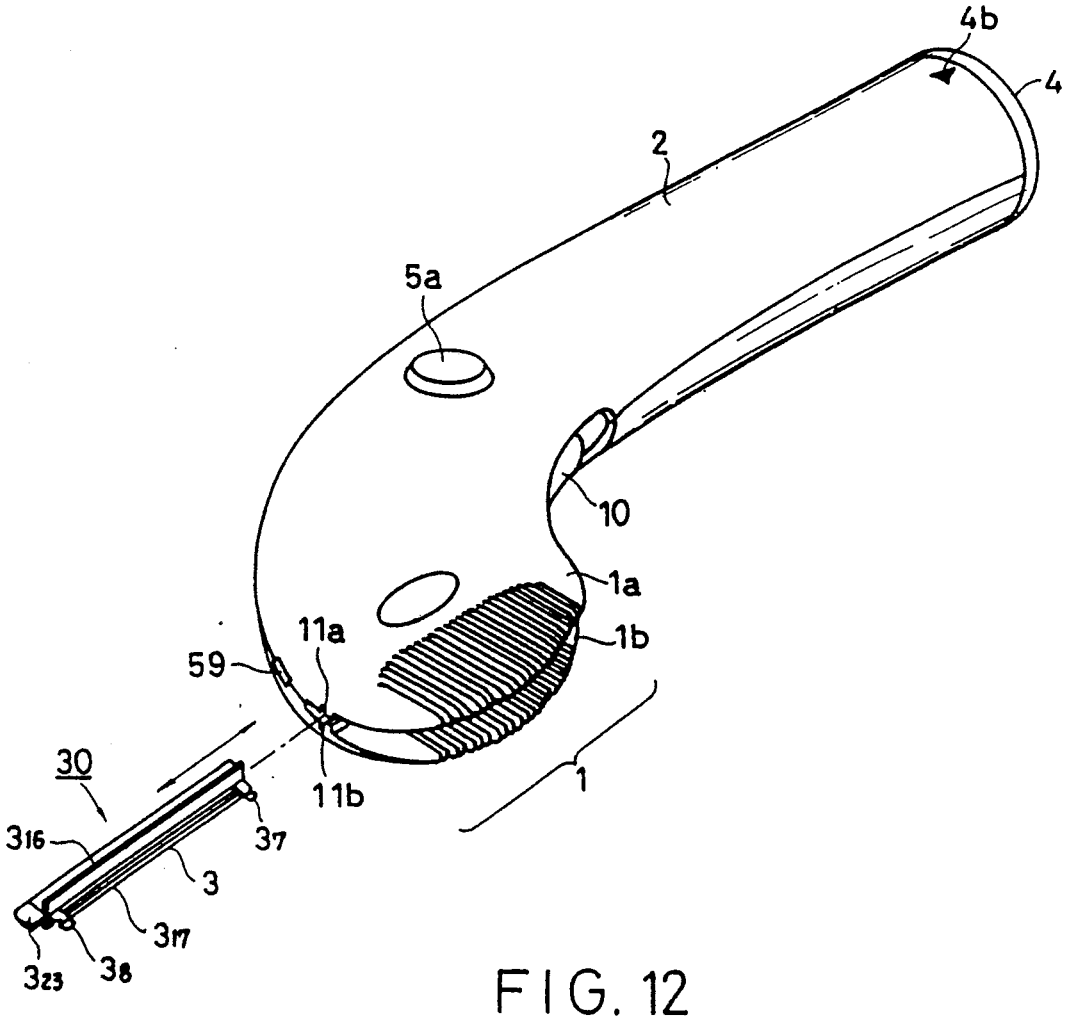
Figure 13:
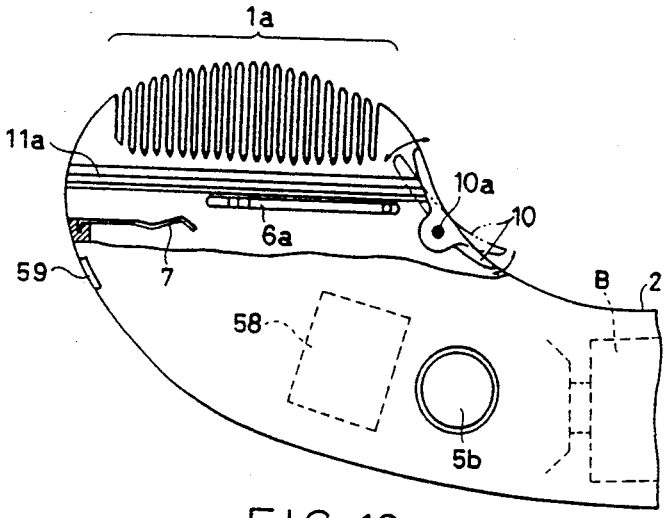
FIG. 13 is a partially broken side elevational view of a comb tooth portion with a removed heater cassette of a hair treating implement, according to the third embodiment shown in FIGS. 7 through 12.
Figure 14:
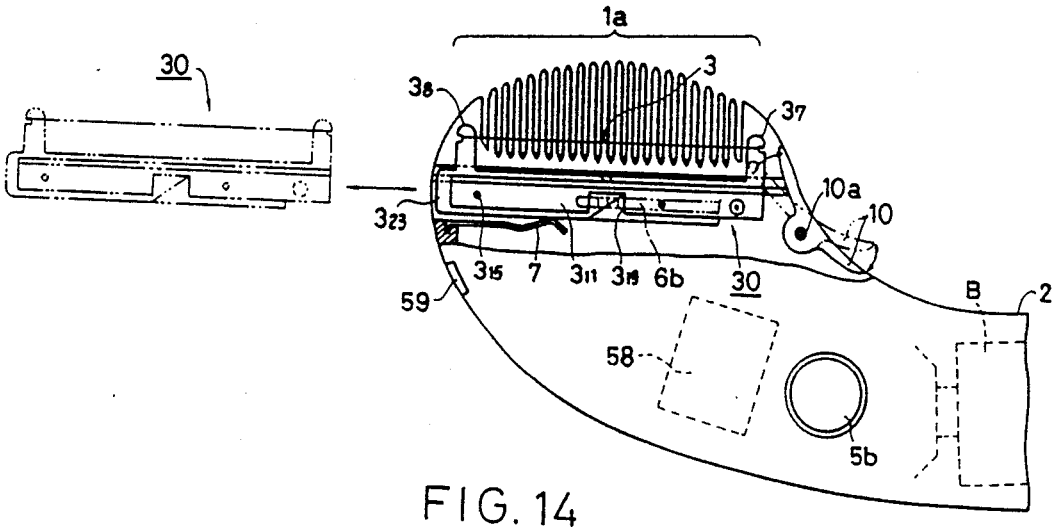
FIG. 14 is a partially broken side elevational view of a comb tooth portion with a heater cassette attached thereto, according to the third embodiment shown in FIGS. 7 through 12.

The heater cassette 30 is inserted from the front end of the comb tooth portion 1 into the space between the left and right comb tooth plates 1*a* and 1*b*, with the front base plate $3_1$ being a leading end upon insertion (FIGS. 12 and 14). Upon insertion, the guide projections $3_{16}$ and $3_{17}$ of the heater cassette 30 are slidably guided in the corresponding left and right guide grooves 11*a* and 11*b* of the comb plates 1*a* and 1*b* in a "tongue-and groove" type interfit.

When the heater cassette 30 is fully inserted in the comb tooth portion 1, front ends of elastically deformable left and right electrode plates 6*a* and 6*b* (FIGS. 13–16), which are provided on the inner side faces of the spine portion of the left and right comb tooth plates 1*a* and 1*b*, are brought at their front ends into elastic contact with the conductor pattern layers $3_5$ and $3_3$ through recessed windows $3_{18}$ and $3_{19}$ formed on the left and right side plates $3_9$ and $3_{10}$ of the heater cassette 30 establishing an electrical connection therebetween, respectively. On the other hand, a leaf spring 7, which is provided in the comb tooth portion 1, is placed below the heater cassette 30. As shown in FIGS. 14 and 17, leaf spring 7 is inserted in the space between the left and right comb tooth plates 1*a* and 1*b* and is brought into elastic contact at its front end with the front end of the lower edge of the rear base plate $3_2$, so that the rear base plate $3_2$ is biased to rotate about the pin $3_{15}$ in the counterclockwise direction (FIG. 17) against tension of heating wire 3.

When the heater cassette 30 is mounted to the comb tooth portion 1 (FIGS. 9 and 14), the heating wire 3 extends tautly in the space (distance W) between the comb tooth plates 1*a* and 1*b*, close to the base end of the comb teeth.

When an operator grasps the hand grip 2 and pushes one or both of the push button switches 5*a* and 5*b*, the power supply circuit 58 (FIG. 15) is turned ON, so that an electrical connection of the batteries B, the electrode plate 6*a*, the conductor pattern layer $3_5$, the heating wire 3, the conductor pattern layer $3_3$ and the electrode plate 6*b* is established.

As a result, the heating wire 3 immediately is heated along the whole length thereof. When the push button switch 5*a* and/or 5*b* is/are released, the power supply circuit 58 is turned OFF, so that no current is fed to the heating wire 3 from the batteries B. Consequently, the NICHROME wire 3 is no longer heated, and decreases in temperature due to a small heat capacitance thereof.

Thus, during operation of the push button switch 5*a* and/or 5*b*, when the NICHROME wire 3 is brought into contact with the body hair at a desired length to be treated a, while combing the hair by the comb tooth portion 1, the NICHROME wire 3 is heated, so that the hair brought into contact therewith is burned and cut. Unlike shearing by a cutting tool, the tips of the hair thus burned and cut are not sharp but round.

The NICHROME wire 3 is guarded by the comb tooth plates 1*a* and 1*b*. Thus there is no danger that a man or woman who is treated by the present implement or an operator can directly touch the heated wire 3.

Figure 18:
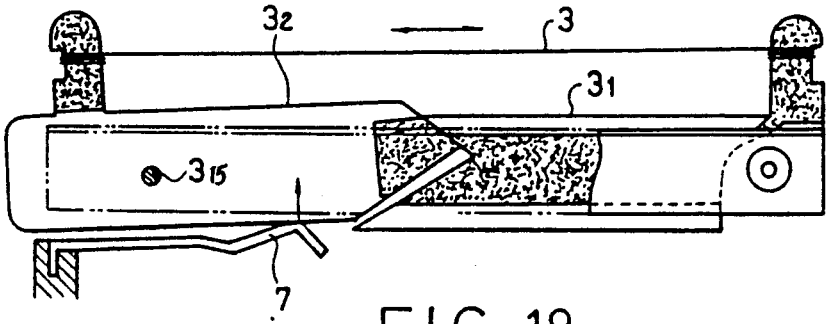
FIG. 18 is a side elevational view of a heater cartridge in an active position in which an electrical power is supplied to a nichrome wire, in the third embodiment of the present invention.
Figure 19:
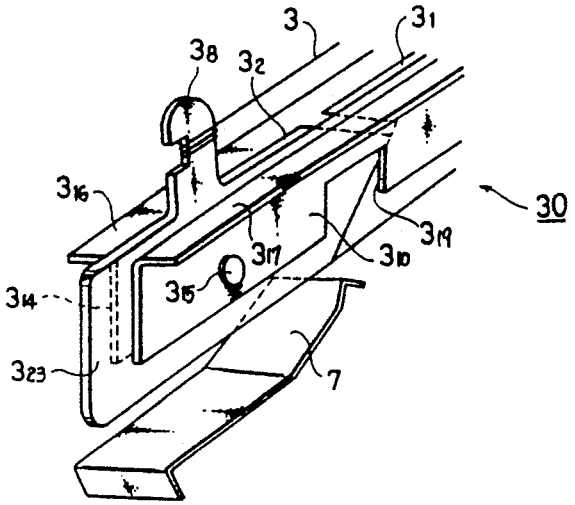
FIG. 19 is a perspective view of a rear base plate of a heater cartridge and a leaf spring, in the third embodiment of the present invention; and, FIGS. 20 and 21 are views similar to FIG. 19, showing a notch and notches which is and are additionally provided on a rear base plate shown in FIG. 19, respectively.

The NICHROME wire 3 which extends between the front and rear projections $3_7$ and $3_8$ of the front and rear base plates $3_1$ and $3_2$ of the heater cassette 30 is slightly elongated due to thermal linear expansion upon heating. The elongation of the heating wire 3 causes the rear base plate $3_2$ to rotate about the pin $3_{15}$ with the help of the spring force of the leaf spring 7 in the counterclockwise direction, as shown in FIG. 18, resulting in an increase of the distance between the front and rear projections $3_7$ and $3_8$ to which the heating wire 3 is connected. Consequently, the elongation of the heating wire 3 due to thermal linear expansion can be absorbed by an increase distance of the projections $3_7$ and $3_8$, so that the heating wire 3 is always in a tensioned state. Therefore, the comb tooth plates 1*a* and 1*b* can be protected from thermal damage by the heating wire 3 which would otherwise be loosened repeatedly and elongated due to thermal linear expansion, resulting in direct contact with or coming very close to the left and right comb tooth plates 1*a* and 1*b*.

When the power supply to the NICHROME wire 3 is broken, the NICHROME wire 3 is linearly contracted due to a decrease in temperature thereof, so that the rear base plate $3_2$ rotates about the pin $3_{15}$ in the clockwise direction in FIG. 18 against the leaf spring 7 from a position shown in FIG. 18 to a position shown in FIG. 17 in which the NICHROME wire 3 extends with a tension between the projections $3_7$ and $3_8$. Namely, the NICHROME wire 3 is always kept tensioned in both the active position of the hair treating implement in which electrical power is supplied and the inactive position in which no electrical power is supplied.

The power supply circuit 58 has a timer function in which the power supply to the NICHROME wire 3 is automatically stopped at a predetermined time (e.g. 30–60 second) after the push button switch 5*a* and/or 5*b* is turned ON, so that even if the push button switch 5*a* and/or 5*b* continues to be pushed down, no over-heating of the NICHROME wire 3 takes place. The timer function is reset every time the push button switch 5*a* or 5*b* is pushed down. When the power supply to the NICHROME wire 3 is automatically broken by the timer function, the power supply can be effected again by pushing the push button switch 5*a* or 5*b*.

Figure 21:
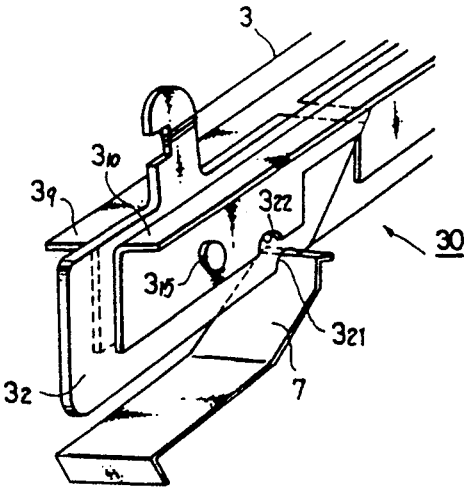
Figure 20:
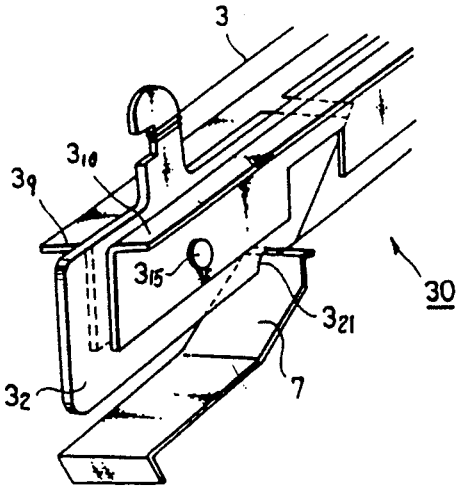

FIG. 20 shows a modified embodiment in which the rear base plate $3_2$ is provided, with a notch $3_{21}$ of, for example, about 0.3 mm depth on its lower edge against which the leaf spring 7 bears. In a variant shown in FIG. 21, additional notches $3_{22}$ are provided on the lower edges of the left and right side plates $3_9$ and $3_{10}$ corresponding to the above-mentioned notch $3_{21}$ of the rear base plate $3_2$ against which leaf spring 7 might also bear. The notch $3_{21}'$ shown in FIG. 21 is deeper than the notch $3_{21}$ shown in FIG. 20.

The provision of the notch $3_{21}$ ($3_{21}'$) and/or the notches $3_{22}$ not only provides a click upon completion of attachment of the heater cassette 30 to the comb tooth portion 1 but also contributes to stable positioning of the heater cassette 30. Furthermore, the notch $3_{21}$ ($3_{21}'$) and the notches $3_{22}$ permit the rear base plate $3_2$ to rotate about the pin $3_{15}$ within an increased angular displacement.

Means for absorbing looseness and elongation of heating wire 3 due to the thermal expansion from a heat generating means to always maintain the heating wire 3 in a tensioned state is not limited to the illustrated embodiments. For instance, it is possible to provide a spring or springs (not shown) which is or are connected to one end or both ends of the heating wire 3 to tension the same.

Figure 15:
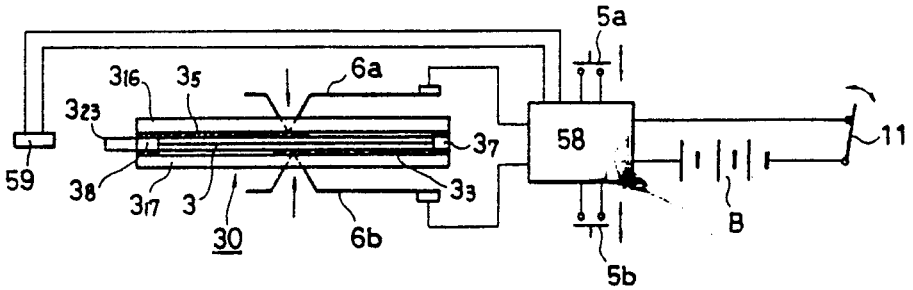
FIG. 15 is a schematic view of an electrical power supply circuit of a heater cartridge shown in FIG. 14.

In FIG. 15, a pilot lamp unit (e.g. LED) 59 having a green lamp and a red lamp, is provided on the front end of the comb tooth portion 1. The pilot lamp unit 59 is controlled by the power supply circuit 58, so that when electrical power is supplied to the heating wire 3 by the operation of the push button switch 5*a* and/or 5*b*, the green lamp lights. When the batteries B are consumed and when the push button switch 5*a* or 5*b* is pushed down, the red lamp is continuously or discontinuously lightened to indicate that the batteries B must be exchanged.

When the NICHROME wire 3 is broken, a lever 10 (FIGS. 9, 12–14) which is provided on the connecting portion of the comb tooth portion 1 and the hand grip 2 so as to rotate about a shaft 10*a* provided on the comb tooth portion 1 is rotated with an operator's finger in the counterclockwise direction to a position shown by an imaginary line in FIG. 14. As a result, the heater cassette 30 which is attached to the comb tooth portion 1 is pushed out at the front end thereof by the lever 10, so that the lug $3_{23}$ provided on the rear end of the rear base plate $3_2$ projects from the comb tooth portion 1. Thus, the lug $3_{23}$ can be grasped by operator's fingers to pull the heater cassette 30 in the direction opposite the insertion direction upon attachment thereof in order to disengage the heater cassette 30 from the comb tooth portion 1. Consequently, the heater cassette 30 can be exchanged for another.

When the hair treatment implement is not used, the plug cap 4 of the battery compartment 2*a* of the hand grip 2 is rotated by about 45 degrees from an operative position shown in FIG. 8, in which a mark 4*c* of the plug cap 4 is registered with a mark 4*a* of the hand grip 2, to an inoperative position in which the mark 4*c* is registered with a mark 4*b* of the hand grip 2, so that switch 11 (FIG. 15), which is associated with the plug cap 4, is opened to open the battery circuit. In this position, no power is supplied to the heating wire 3, even if the push button switch 5*a* or 5*b* is actuated. When the plug cap 4 is rotated by 45° in the reverse direction (clockwise direction), so that the mark 4*c* registers with mark 4*a*, the switch 11 is closed to close the battery circuit.

When the plug cap 4 is detached from the hand grip 2 to load or unload the batteries B into and from the battery compartment 2*a* of the hand grip 2, the plug cap 4 is rotated by about 90° in the clockwise direction from a position shown in FIG. 8 in which the mark 4*c* is registered with the mark 4*a*.

The batteries B received in the hand grip 2 allow for a cordless hair treating implement which can be easily operated. Alternatively, it is possible to provide a receptacle and a plug as shown in FIG. 5. Namely, for example, a receptacle is provided on the rear end of the hand grip 2 while a detachable plug is provided with a separate battery holder through an electrical connecting cord, so that the plug can be inserted in the receptacle to supply power to the hair treatment implement. The separate battery holder makes the hair treatment implement lighter and more easily operable.

It is possible to directly connect the hair treatment implement to the separate battery holder through the connecting cord without using the receptacle and plug.

It is also possible to connect the hair treating implement to a commercial power source through a voltage reducer by an electrical connecting cord.

I claim:

1. A hair treating implement comprising an electrical heating wire, a slidably removable support supporting said heating wire under tension, a handgrip including means slidably receiving said slidably removable support, said support including terminals to which opposite ends of said heating wire are connected to supply electrical power to said heating wire, and wherein said means for slidably receiving comprises a longitudinally extending groove which receives said slidably removable support as a tongue-and-groove fit.

2. A hair treating implement according to claim 1, wherein said hand grip comprises a power source receiving portion in which a power source is stored.

3. A hair treating implement according to claim 2, wherein said hand grip comprises a power switch which turns said power source ON and OFF.

4. A hair treating implement according to claim 2, wherein said power source is at least one battery stored in said power source receiving portion of said hand grip.

5. A hair treating implement according to claim 1, wherein said handgrip comprises a connecting portion adapted to be connected to an external power source for supplying power to said heating wire.

6. A hair treating implement comprising an electrical heating wire, a slidably removably positionable substrate supporting said heating wire under tension, a handgrip including means slidably removably supporting said slidably removable substrate, a comb tooth portion including a pair of opposed and spaced comb tooth plates, said substrate and said heating wire extending in a space between said comb tooth plates, and said handgrip supporting said comb tooth portion.

7. A hair treating implement according to claim 6, wherein said heating wire and said substrate form a heater cassette, said heater cassette being slidably removably positioned in said supporting means between said comb tooth plates.

8. A hair treating implement according to claim 7, wherein said heater cassette comprises electrical terminals through which electrical power is supplied to said heating wire.

9. A hair treating implement according to claim 8, wherein said hand grip comprises supplier terminals which can be connected to said electrical terminals to supply electrical power to said heating wire.

10. A hair treating implement according to claim 9, wherein said handgrip comprises a power source receiving portion connected with said supplier terminals, in which a power source is stored.

11. A hair treating implement according to claim 10, wherein said hand grip comprises a power switch which turns said power source ON and OFF.

12. A hair treating implement according to claim 9, wherein said hand grip comprises a connecting portion which can be connected to an external power source.

13. A heater treating implement according to claim 9, wherein said hand grip further comprises means for ejecting said heater cassette from said implement.

14. A hair treating implement according to claim 7, wherein said heater cassette further comprises a stationary base plate with a vertical projection at one end, and a movable base plate with a vertical projection at one end, said movable base plate being pivotally fixed to said support, wherein said heating wire is supported between said stationary base plate vertical projection and said movable base plate vertical projection and said movable plate is biased away from said stationary plate to apply tension to said heating wire.

15. A hair treating implement according to claim 14, wherein said stationary base plate and said movable base plate are arranged so that said vertical projections are oppositely arranged along the longitudinal axis of said implement.

16. A hair treating implement according to claim 14, wherein said heater cassette is provided with a means for biasing said movable base plate counterclockwise about said pivot in order to maintain tension on said heating wire.

17. A hair treating implement according to claim 14, wherein said heater cassette is further provided with a protrusion which remains extended when said heater cassette is inserted into said implement in order for the user to grasp said cassette for removal.

18. A hair treating implement comprising a heater cassette, means slidably removably supporting said heater cassette, said heater cassette comprising an electrical heating wire extending tautly between two oppositely arranged terminals of a support and means for absorbing looseness and elongation of said heating wire due to thermal expansion upon heating, wherein said means slidably supporting comprises a longitudinally extending groove means and said heater cassette comprises a longitudinally extending tongue means which interfits with said groove means.

19. A hair treating implement according to claim 18, wherein said means for absorbing comprises a stationary base plate connected to one end of said heating wire, at least one movable base plate pivotably movable relative to said stationary base plate, and a biasing means for biasing said at least one moveable base plate in a direction so as to maintain tautness of said heating wire, said at least one movable base plate being connected to another end of said heating wire.

20. A hair treating implement according to claim 18, further comprising a hand grip which is connected to said means for removably supporting said heater cassette.

21. A hair treating implement according to claim 20, wherein said hand grip comprises a battery compartment adapted to store at least one battery to supply electrical power to said wire.

22. A hair treating implement according to claim 21, wherein said handgrip comprises a switch which turns said at least one battery ON and OFF.

23. A hair treating implement according to claim 20, wherein said hand grip comprises a connecting portion which can be connected to an external power source.

24. A hair treating implement according to claim 20, further comprising a power supply circuit in said grip, adapted to supply electrical power to said wire.

25. A hair treating implement according to claim 24, wherein said power supply circuit is provided with means for controlling an interval of time of supply of electrical power to said heating wire.

26. A hair treating implement according to claim 25, further comprising means on said support for indicating the supply of electrical power to said heating wire.

27. A hair treating implement according to claim 26, further comprising means on said support for indicating the consumption of electrical power by said heating wire.

28. A hair treating implement according to claim 24, wherein said power supply circuit is provided with means for controlling an interval of time of supply of electrical power to said heating wire.

29. A hair treating implement according to claim 28, further comprising means on said support for indicating the supply of electrical power to said heating wire.

30. A hair treating implement according to claim 29, further comprising means on said handgrip for indicating the consumption of electrical power by said heating wire.

31. A hair treating implement according to claim 13, further comprising a power supply circuit in said means for removably supporting said heater cassette, adapted to supply electrical power to said wire.

32. A hair treating implement according to claim 18, further comprising a comb tooth portion having a pair of opposed and spaced comb tooth plates, and wherein said support and said heating wire extends between said comb tooth plates.

33. A hair treating implement according to claim 32, wherein said support comprises a predetermined pattern of electrical conductors adapted to supply electrical power to said heating wire.

34. A hair treating implement comprising a handgrip having an integral comb tooth portion, and a heater cassette in which a heating wire is supported and which is detachable from said handgrip, said heating wire being located in said comb tooth portion when said heating cassette is attached to said handgrip, wherein said handgrip portion comprises a longitudinally extending slot for slidably receiving said heater cassette in a tongue and groove connection.

35. A hair treating implement according to claim 34, wherein said comb tooth portion has a pair of opposed and spaced comb tooth plates, said heating wire supported by said heater cassette being located in a space between said comb tooth plates when said heating cassette is attached to said hand grip.

36. A hair treating implement comprising a handgrip integral with a comb tooth portion, and a heater cassette in which a heating wire is supported and which is detachable from said handgrip, wherein said heating wire is supported adjacent said comb tooth portion, and said heater cassette is slidably received by said handgrip in a tongue and groove interfit.

* * * * *